US009850667B2

(12) United States Patent
Engstrom

(10) Patent No.: US 9,850,667 B2
(45) Date of Patent: Dec. 26, 2017

(54) PANEL WITH A FASTENING DEVICE

(71) Applicant: Välinge Innovation AB, Viken (SE)

(72) Inventor: Nils-Erik Engstrom, Trelleborg (SE)

(73) Assignee: VALINGE INNOVATION AB, Viken (SE)

( * ) Notice: Subject to any disclaimer, the term of this patent is extended or adjusted under 35 U.S.C. 154(b) by 0 days.

(21) Appl. No.: 15/243,219

(22) Filed: Aug. 22, 2016

(65) Prior Publication Data

US 2017/0058534 A1 Mar. 2, 2017

(30) Foreign Application Priority Data

Aug. 24, 2015 (SE) ..... 1551091

(51) Int. Cl.
*E04F 15/02* (2006.01)
*E04F 13/08* (2006.01)

(52) U.S. Cl.
CPC ..... *E04F 13/0826* (2013.01)

(58) Field of Classification Search
CPC ..... E04F 15/04; E04F 15/02044; E04F 15/02; E04F 2015/02094; E04F 2201/05; E04F 2015/0205
See application file for complete search history.

(56) References Cited

U.S. PATENT DOCUMENTS 8,291,666 B1 10/2012 Garrison
8,544,229 B2 * 10/2013 Kilgore ..... E04F 15/02044 52/177
9,140,020 B2 * 9/2015 Torres-Pinzon .. E04F 15/02044
9,181,715 B2 * 11/2015 Orchard ..... E04F 15/02044
(Continued)

FOREIGN PATENT DOCUMENTS

CA 2 792 923 A1 4/2013
CN 104775595 A 7/2015
(Continued)

OTHER PUBLICATIONS

International Search Report issued in PCT/SE2016/050777, dated Nov. 11, 2016, Patent-och registreringsverket, Stockholm, SE, 5 pages.

*Primary Examiner* — Rodney Mintz
*Assistant Examiner* — Daniel Kenny
(74) *Attorney, Agent, or Firm* — Buchanan Ingersoll & Rooney P.C.

(57) ABSTRACT

The present disclosure relates to a set comprising a supporting structure, first and second panels and a fastening device for securing the first and second panels to the supporting structure. The fastening device comprises a top portion, having top and bottom surfaces, first and second edge portions, and first and second legs protruding downwardly from the bottom surface. The first and second panels respectively comprise opposite first and second edge grooves into which the first and second edge portions are configured to be respectively inserted. The first and second legs are flexible and bendable towards each other, and respectively comprise first and second locking elements. An upper surface of the supporting structure comprises an insertion groove comprising a first undercut groove and an opposite second undercut groove. The first and second locking elements are respectively configured to be snapped into the first and second undercut grooves to a locked position.

14 Claims, 8 Drawing Sheets

(56) References Cited

U.S. PATENT DOCUMENTS

| | | | | |
|---|---|---|---|---|
| 2013/0025228 | A1 | 1/2013 | Kilgore et al. | |
| 2013/0025230 | A1* | 1/2013 | Turner | E04F 15/02044 52/586.1 |
| 2013/0104493 | A1 | 5/2013 | Orchard | |
| 2014/0260041 | A1 | 9/2014 | Peck et al. | |

FOREIGN PATENT DOCUMENTS

| | | | |
|---|---|---|---|
| CN | 104831903 | A | 8/2015 |
| DE | 20 2009 007 507 | U1 | 9/2009 |
| DE | 20 2010 004 268 | U1 | 7/2010 |
| EP | 2 711 481 | A1 | 3/2014 |
| EP | 2 816 172 | A2 | 12/2014 |
| FR | 3032739 | A1 | 8/2016 |
| JP | 2014/214498 | A | 11/2014 |
| WO | WO 2015/174835 | A1 | 11/2015 |

* cited by examiner

PANEL WITH A FASTENING DEVICE

TECHNICAL FIELD

The present disclosure relates to a fastening device for connecting a panel to a supporting structure, such as a joist.

TECHNICAL BACKGROUND

Fastening devices, such as a clip secured to a joist by a screw or nail, for connecting a panel to the joist are known from e.g. CA 2 792 923. Also known is a clip device which is secured to a joist by bendable legs that are snapped around the joist, see e.g. DE202009007507U1. A drawback with the known fastening devices is that it is time consuming to assemble the panel to the supporting structure.

The above description of various known aspects is the applicant's characterization of such, and is not an admission that any of the above description is considered as prior art.

SUMMARY

It is an object of certain embodiments of the present disclosure to provide an improvement over the above described techniques and known art. Particularly to reduce the time for assembling and to provide a tool-less assembling. A further object is to provide a fastening device of a small size which may be easy to handle, transport and/or store.

At least some of these and other objects and advantages that will be apparent from the description have been achieved by a first aspect of the disclosure that comprises a set comprising a supporting structure, such as a joist, a first panel, a second panel and a fastening device for securing the first panel and the second panel to the supporting structure. The fastening device comprises a top portion, having a top surface, a bottom surface, a first edge portion and a second edge portion. A first leg and a second leg protrude downwardly from the bottom surface. The first panel comprises a first edge groove and the second panel comprises an opposite second edge groove. The first edge portion is configured to be inserted into the first edge groove and the second edge portion is configured to be inserted into the second edge groove. The first leg and the second leg are flexible and bendable towards each other. The first leg comprises a first locking element and the second leg comprises a second locking element. An upper surface of the supporting structure comprises an insertion groove comprising a first undercut groove and an opposite second undercut groove. The first locking element is configured to be snapped into the first undercut groove and the second locking element is configured to be snapped into the second undercut groove to a locked position.

The first panel and the second panel are preferably essentially identical.

The first edge groove and the second edge groove may be at a first long edge and a second long edge, respectively, of the first panel and the second panel. Two or more of said fastening device may be arranged along the first edge groove and the second edge groove.

The fastening element is preferably configured to be inserted into the insertion groove by inserting the first edge portion into the first edge groove of the first panel and angling down the first panel against the upper surface of the supporting structure and pushing the panel vertically downwards such that the first and second legs are bent towards each other. The first locking element and the second locking element are configured to snap into the first undercut groove and the second undercut groove, respectively, when the locking device has reached a locked position.

A lower surface of the first locking element and/or the second locking element may comprise a bevelled edge configured to cooperate with a groove edge of the insertion groove during an insertion of the first second leg and the second leg into the insertion groove.

The top surface may comprise a top groove, preferably with a curved surface, for receiving an outer edge of the second panel when the second panel is in angled position. The top groove may facilitate insertion of a second of said locking device in a first edge groove of the second panel by angling up the second panel before inserting the second of said locking device in a first edge groove of the second panel.

The first locking element and the second locking element may each comprise an upper locking surface. The first and second undercut grooves may each comprise an upper surface. The locking surface of the first locking element may be configured to cooperate with the upper surface of the first undercut groove and the locking surface of the second locking element may be configured to cooperate with an upper surface of the second undercut groove.

The locking surface of the first and second locking elements may each comprise a rounded or bevelled surface to enable an angled position of the fastening device while the first and second locking elements may be within the first and second undercut grooves, respectively.

A lower surface of the first locking element and a lower surface of the second locking element may each comprise a bevelled edge or a rounded edge which is configured to interact with the supporting structure during an assembling of the set.

The first leg may comprise a first outer surface and the second leg may comprise a second outer surface, wherein a distance between the first outer surface and the second outer surface may be essentially the same as a width of an opening of the insertion groove.

The first leg may comprise a first outer surface and the second leg may comprise a second outer surface, wherein the first outer surface and/or the second outer surface may comprise a protruding element for a vertical positioning of the fastening device.

The top portion may comprise a friction connection, such as protruding parts, configured to cooperate with the first edge groove and/or the second edge groove and to restrain the fastening device from falling out during an assembling of the set.

The fastening device may comprise a polymer material, such a polyamide e.g. PA6 or PA11/12, or polypropylene. The fastening device is preferably injection moulded. The material may be reinforced with e.g. glass fibre.

A core of the first and second panels may be a wood-based core, such as solid wood or WPC. The core may comprise a polymer, such as a thermoplastic material, PP and PVC, and may comprise further components such as a filler, wood powder or rice husk. The core may also be of MDF, HDF, OSB, plywood, particle board or a metal such as aluminium. The WPC core may be provided with a decorative layer, such as a foil on one or more surfaces.

The first and second panels may be decking, roof, wall or ceiling panels.

BRIEF DESCRIPTION OF THE DRAWINGS

The present disclosure will by way of example be described in more detail with reference to the appended schematic drawings, which show embodiments of the present disclosure.

DETAILED DESCRIPTION

Figure 1A:
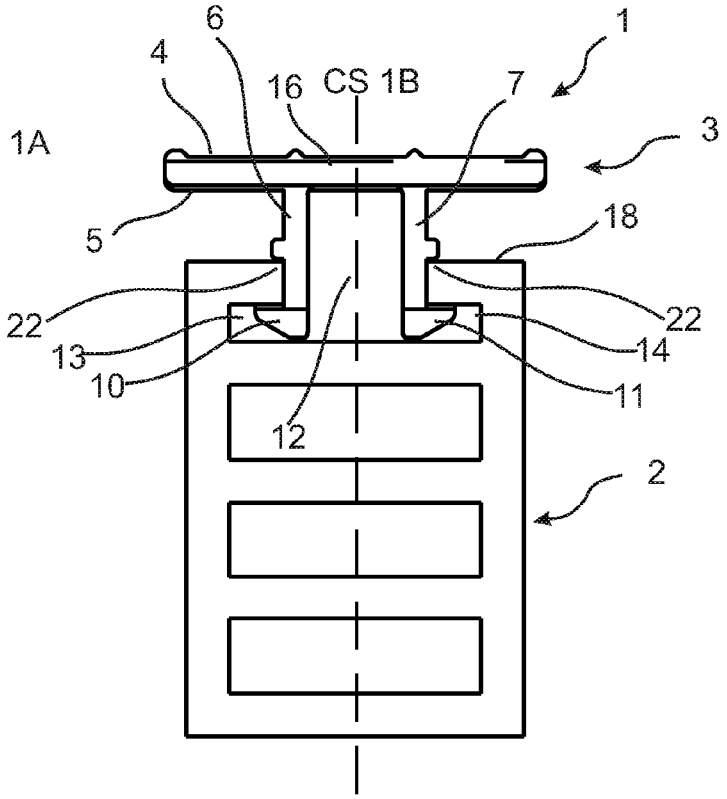
FIGS. 1A-1B show an embodiment of the disclosure.
Figure 1B:
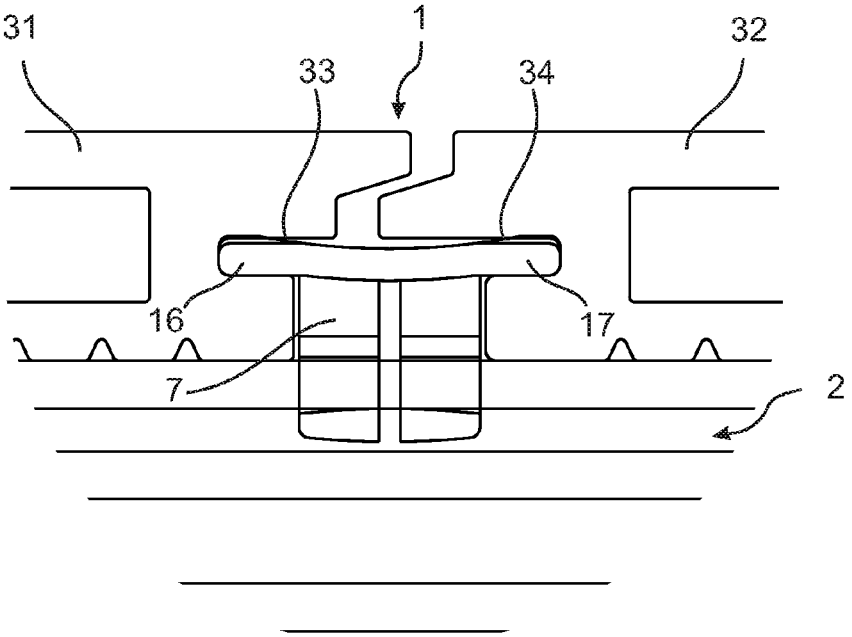

An embodiment of the disclosure is shown in FIGS. 1A-B. FIG. 1 shows a supporting structure 2, such as a joist, and a fastening device 1 for securing first and second panels 31, 32, see FIG. 1B, to the supporting structure 2. FIG. 1B shows a cross cut CS1*b* of the FIG. 1A. The fastening device comprises a top portion 3, having a top surface 4, a bottom surface 5, a first edge portion 16 and a second edge portion 17, a first leg 6 and a second leg 7 protruding downwardly from the bottom surface. The first panel 31 comprises a first edge groove 33 and the second panel comprises an opposite second edge groove 34. The first edge portion 16 is configured to be inserted into the first edge groove 33 and the second edge portion 17 is configured to be inserted into the second edge groove 34. The first leg 6 and the second leg 7 are flexible and bendable towards each other. The first leg 6 comprises a first locking element 10 and the second leg 7 comprises a second locking element 11. An upper surface 18 of the supporting structure 2 comprises an insertion groove 12 comprising a first undercut groove 13 and an opposite second undercut groove 14. The first locking element 10 is configured to be snapped into the first undercut groove 13 and the second locking element 11 is configured to be snapped into the second undercut groove 14 to a locked position. The fastening element 1 is preferably configured to be inserted into the insertion groove 12 by inserting the first edge portion 16 into the first edge groove 33 of the first panel 31 and angling down the first panel 31 against the upper surface 18 of the supporting structure 2 and pushing the first panel 31 vertically downwards such that the first and second legs 6,7 are bent towards each other. The first and second locking elements 10, 11 are configured to snap into the first and second undercut grooves 13, 14, respectively, when the locking device has reached a locked position.

Figure 2A:
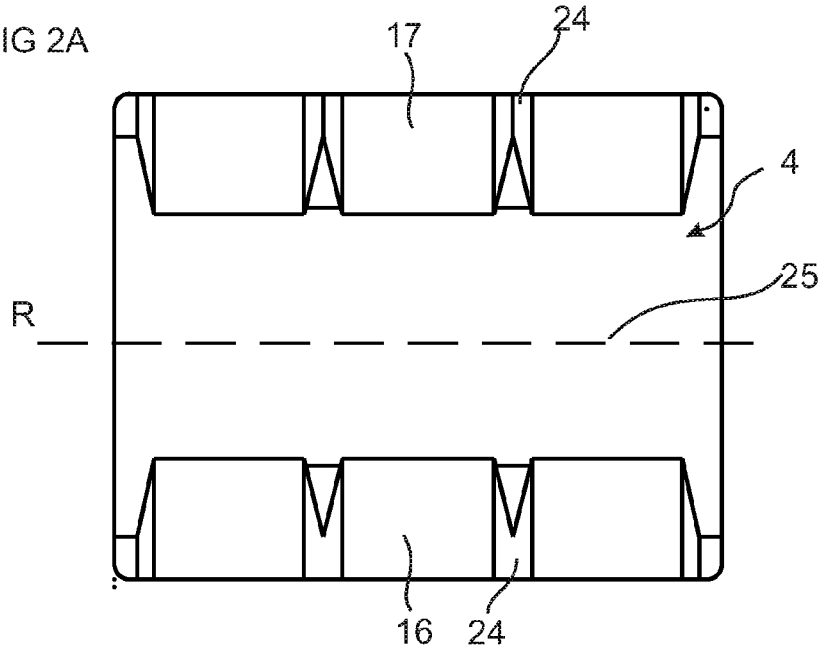
FIGS. 2A-2C show an embodiment of the fastening device according to an embodiment of the disclosure.
Figure 2B:
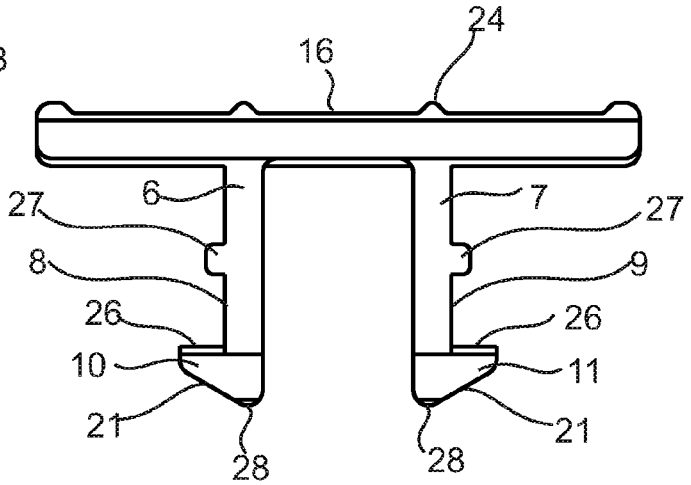
Figure 2C:
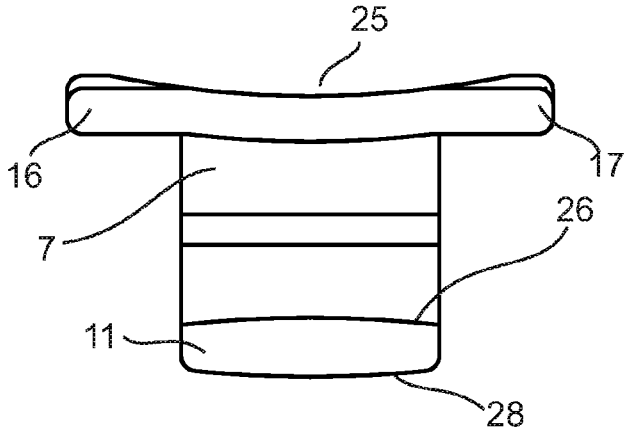

FIG. 2A shows an embodiment of the top portion 3 in a top view of an embodiment of the fastening device. A top surface 4 comprises a top groove 25, preferably with a curved surface, for receiving an outer edge of the second panel when the second panel is in angled position. The top surface 4 may comprise a friction connection, such as protruding parts 24, configured to cooperate with the first edge groove and/or the second edge groove and to restrain the fastening device from falling out during an assembling of the fastening device and the supporting structure. FIG. 2B shows a first side view and FIG. 2C shows a second perpendicular side view of the embodiment shown in FIG. 2A. A lower surface of the first locking element 10 and/or the second locking element 11 may each comprise a bevelled edge 21 configured to cooperate with a groove edge 22 of the insertion groove during an insertion of the first and second legs 6, 7 into the insertion groove 12. The first locking element 10 and the second locking element 11 each comprise an upper locking surface 26. The locking surface 26 of the first locking element 10 is configured to cooperate with an upper surface of the first undercut groove 13 and the locking surface 26 of the second locking element 11 is configured to cooperate with an upper surface of the second undercut groove 14.

The locking surface 26 of the first and second locking elements 10, 11 may each comprise a rounded or bevelled surface to enable an angled position of the fastening device 1.

A lower surface of the first locking element 10 and a lower surface of the second locking element 11 may each comprise a bevelled edge or rounded edge 28 which is configured to interact with the supporting structure during an assembling. The bevelled edge or the rounded edge 28 is configured such that the fastening device remains in the first edge groove during an assembling comprising an angling movement. The lower surface of the first locking element and the second locking element, respectively, may be configured to cooperate with a wall surface of the supporting structure for a vertical positioning of the fastening device 1. An embodiment of an assembling is shown in FIGS. 3A-3E.

The first leg 6 comprises a first outer surface 8 and the second leg 7 comprises a second outer surface 9. A distance between the first outer surface and the second outer surface is preferably essentially the same as a width of an opening of the insertion groove.

The first outer surface and/or the second outer surface may comprise a protruding element 27 for a vertical positioning of the fastening device 1.

A preferred embodiment of the fastening device comprises a polymer material, such a polyamide, e.g. PA6, PA11/12 or PP. The fastening device is preferably injection moulded. The material may be reinforced with e.g. glass fibre.

Figure 3A:
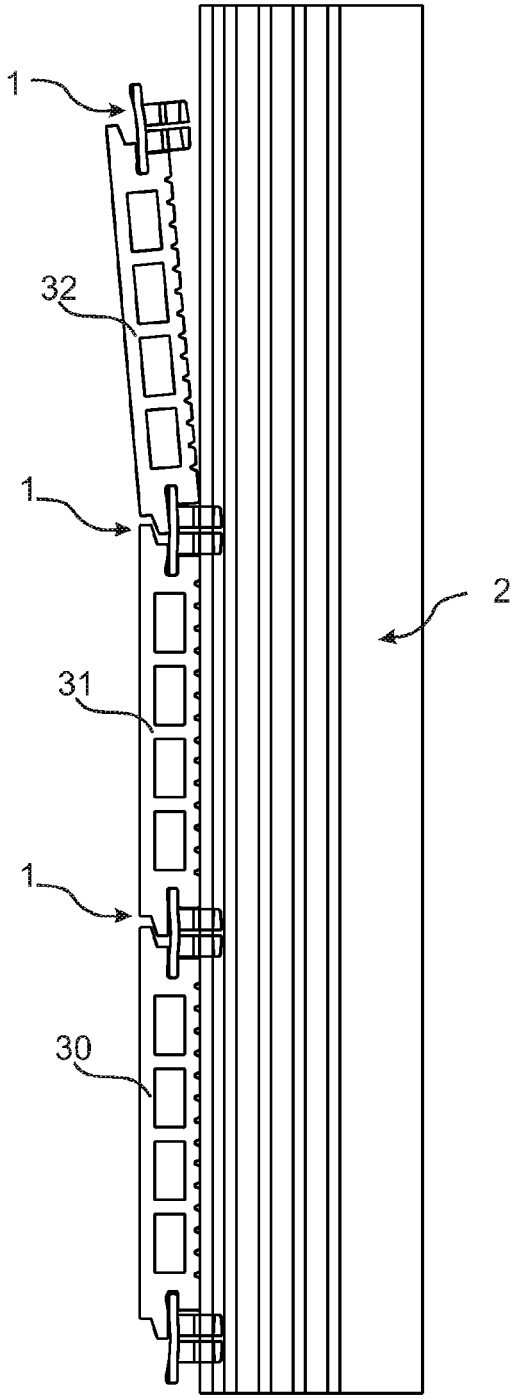
FIGS. 3A-3E show an embodiment of an assembling of an embodiment of the disclosure.
Figure 3B:
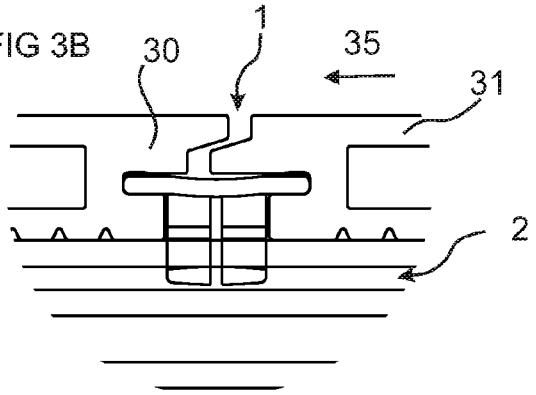
Figure 3C:
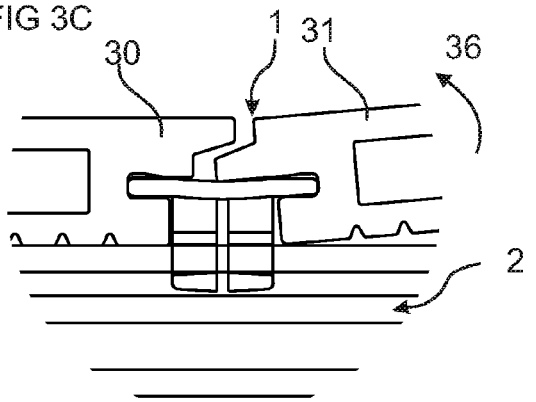
Figure 3D:
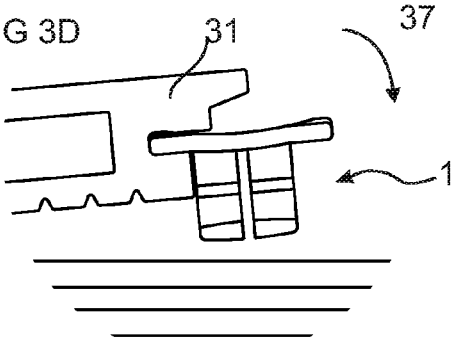
Figure 3E:
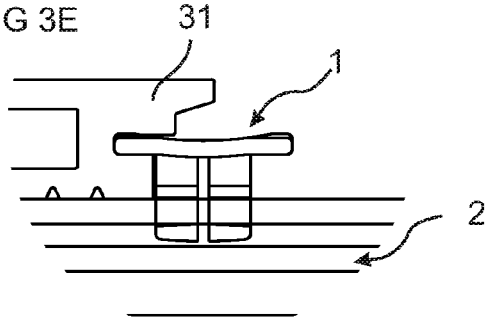

FIGS. 3A-3E show an embodiment of an assembling of embodiments of said panels, fastening elements and supporting structure. FIG. 3A shows an installed panel 30, the first panel 31 and the second panel 32, which are preferably essentially identical. A joint between the installed panel and the first panel and a joint between the first panel and the second panel each comprise at least one of said fastening device 1. The first groove and the second groove of the installed panel 30, the first panel 31 and the second panel 32, are preferably provided at long edges of the installed panel 30, the first panel 31 and the second panel 32, respectively. The second groove of the installed panel is connected to the supporting structure by one or more of said fastening device 1. The first edge portion 16 of one of said fastening device 1 is inserted into the first edge groove of the second panel 32. FIGS. 3B-3E each show an enlargement of a joint during assembling between the panels shown in FIG. 3A. FIG. 3B shows that the first panel 31 is displaced in a horizontal direction 35 towards the installed panel 30 until the first edge portion of the fastening device 1 is inserted into the second edge groove of the first panel 31. FIG. 3B shows that the first panel is angled upward 36 to an angled position to enable insertion of the first edge portion 16 of at least one of said fastening device 1 into the first edge groove of the first panel 31. FIG. 3D shows that the first panel, with the first edge portion 16 of at least one of said fastening device 1 provided in the first edge groove, is angled downward 37. The first panel 31 is pushed vertically downwards until the fastening device has reached the locked position shown in FIG. 3E. The second panel 32 is connected to the first panel 31 by displacing the second panel in a horizontal direction until the first edge portion of the fastening device 1 is inserted into the second edge groove of the second panel 31.

Figure 4:
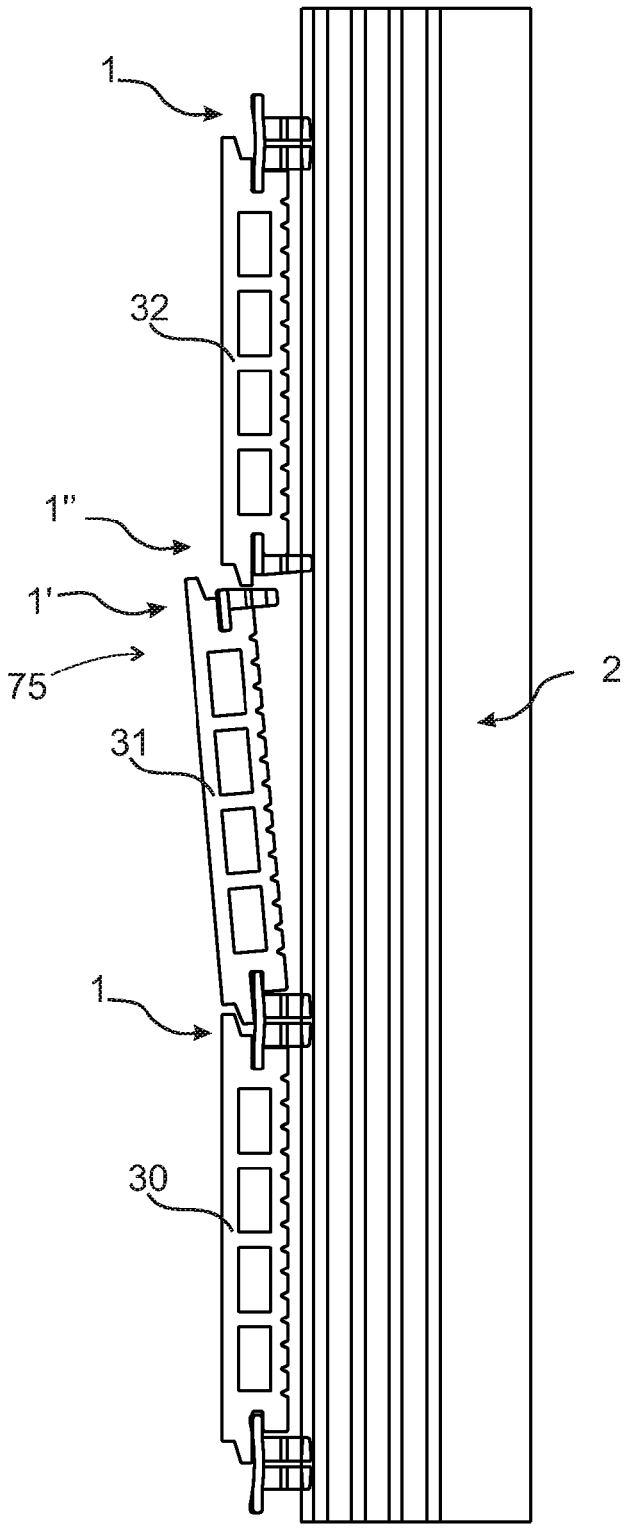
FIG. 4 shows an embodiment of an assembling of an embodiment of the disclosure.
Figure 5:
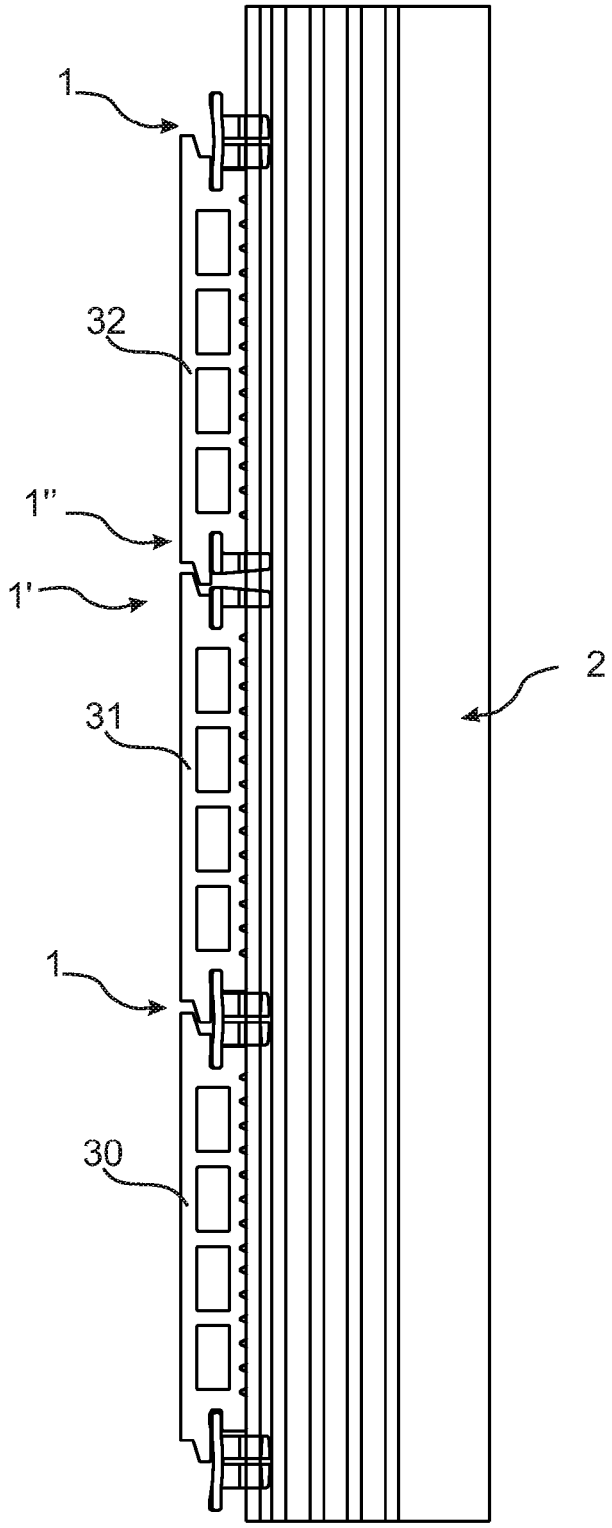
FIG. 5 shows an embodiment of the disclosure in an assembled position.

FIG. 4 and FIG. 5 show an embodiment of replacing an assembled first panel and reassembling the panels. Replacing an assembled panel may be desired if the assembled panel is damaged or if access is required to a space under the assembled panel. The assembled first panel may be cut and removed and replaced by a new first panel 31.

Figure 6A:
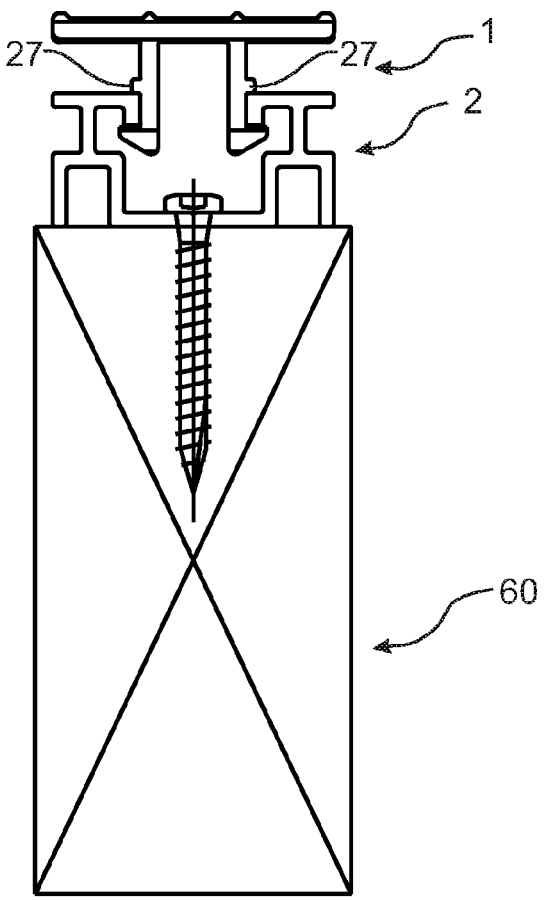
FIG. 6A-6C show embodiments of the disclosure.
Figure 6B:
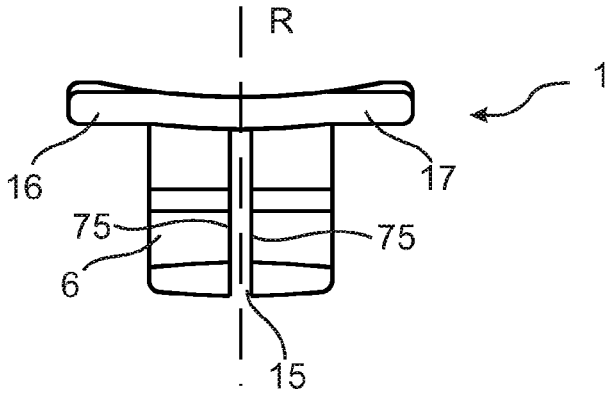

The fastening device 1 may be divided into two halves as indicated by the lines R in FIG. 2A and FIG. 6B. The fastening device may comprise one or more indentations that facilitate dividing of the fastening device.

Figure 6C:
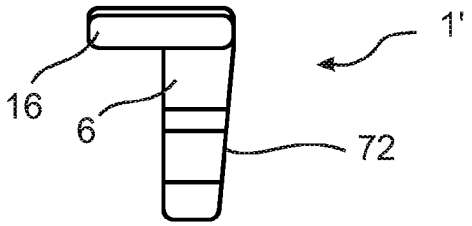

Another alternative is that replacement fastening devices are provided, which are configured as a left half 1' of the fastening device and a right half 1". An enlargement of the left half is shown in FIG. 6C. The first and second legs 6, 7 may be downwardly narrowing in order to facilitate angling in of the new first panel. The first edge portion 16 of the left half 1' is inserted into the first edge grove of the new first panel 31 and the second edge portion 17 of the right half 1" is inserted into the second edge groove of the second panel 32 as shown in FIG. 4. The new first panel is thereafter angled down to the assembled position shown in FIG. 5. Oblique edges 72 of the downwardly narrowing first and second legs 6,7 may have the effect that a collision with the second panel 32 is avoided.

FIG. 6A shows an embodiment of said supporting structure 2 which may be fixed to a joist, e.g. a wood joist. The supporting structure may be fixed by e.g. a screw or a nail. There is no contact at the lower surface of the first locking element 10 and the lower surface of the second locking element 11. The protruding elements 27 cooperate with a surface of the supporting structure 2 for vertical positioning of the fastening device 1.

FIG. 6B shows an embodiment of said fastening device. The first leg 6 and the second leg 7 (not shown) each comprise a dividing groove 15 in order to increase the flexibility of the first leg. The dividing groove may have parallel edges 75 as shown in the figure or non-parallel oblique edges such that the dividing groove is downwardly widening.

Figure 7A:
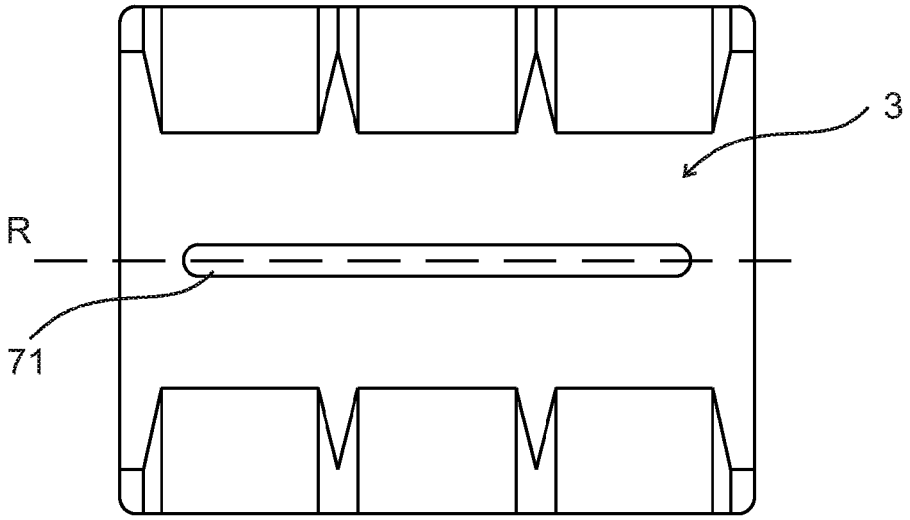
FIGS. 7A-7C show an embodiment of the fastening device according to an embodiment of the disclosure.
Figure 7B:
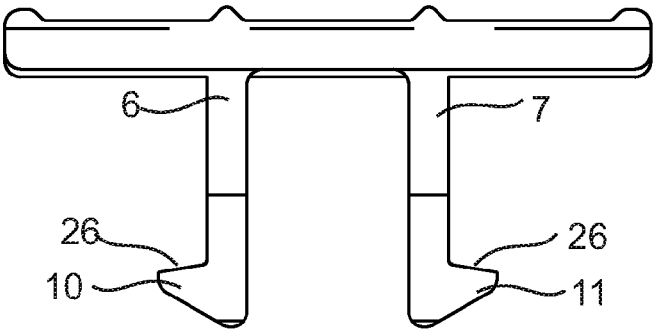
Figure 7C:
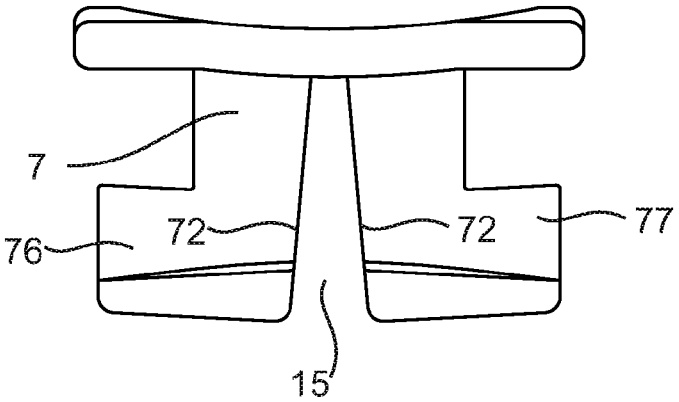

FIG. 7A-7C shows an embodiment of the fastening device 1 that may be divided into two halves as indicated by the lines R. FIG. 7A shows a top view, FIG. 7B shows a first side view and FIG. 7C shows a second perpendicular side view of the embodiment. The top portion 3 of fastening device comprises a groove 71 that facilitates dividing of the fastening device into two halves as indicated by the lines R.

The first leg 6 and the second leg 7 may each comprise a first securing element 76 and a second securing element 77. The first securing element 76 and the second securing 77 are configured for securing the fastening device 1 to the first panel and the second panel respectively during assembling. The first and second securing elements preferably protrude from a lower part of the first leg and the second leg.

The first leg 6 and the second leg 7 each comprise a dividing groove 15 in order to increase the flexibility of the first leg. The dividing groove may have oblique edges 72 such that the dividing groove is downwardly widening. The first and second locking elements 10, 11 each preferably comprise a downwardly sloping locking surface 26.

Figure 8A:
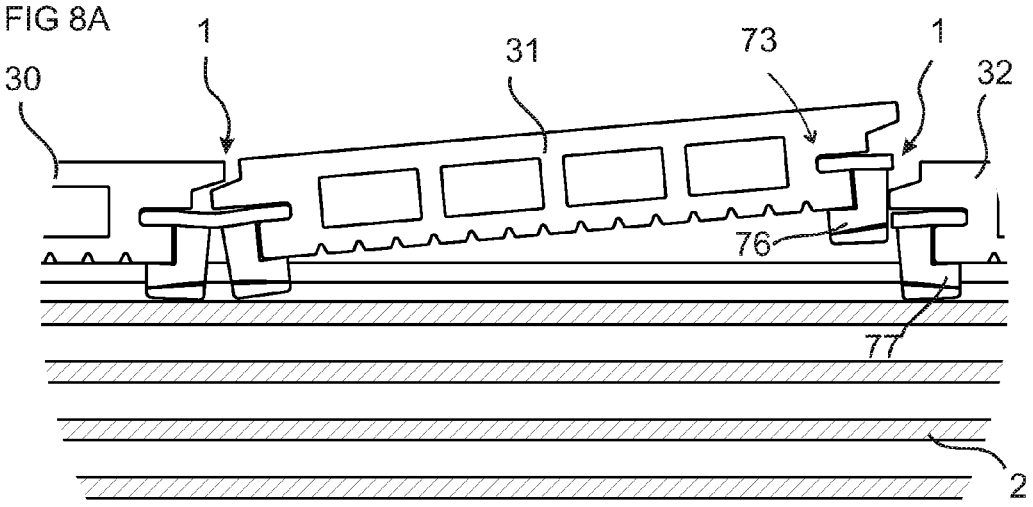
FIGS. 8A-8C show embodiments of the disclosure.

FIG. 8A shows an embodiment of the replacing of an assembled first panel and reassembling the panels. The embodiment comprising securing a left half of the fastening device to the first panel 31 and a right half of the fastening device to the second panel 32. The left half is secured to the first panel by a first securing element 76 and the right half is secured to the second panel by a second securing element 77, and the first panel is angled downwards 73.

Figure 8B:
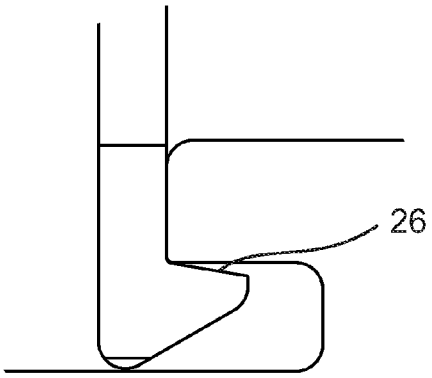

FIG. 8B shows an embodiment of the fastening device comprising a locking surface 26 sloping downwards. This may facilitate snapping in of the first and second locking elements into the first undercut groove and the second undercut groove, respectively, particularly if the vertical position of the locking surface is not completely correct in relation to the first undercut or the second undercut.

Figure 8C:
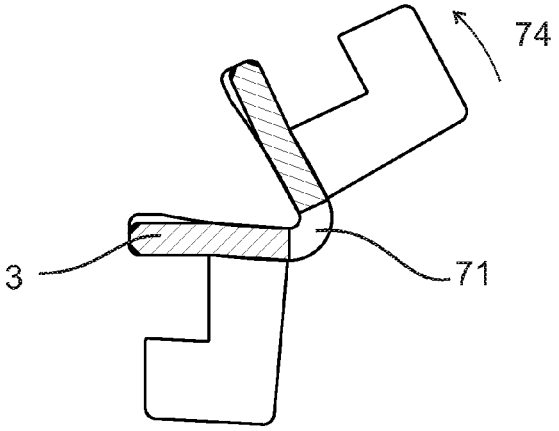

FIG. 8C shows, in a crosscut view, an embodiment of the fastening device comprising a top portion 3 comprising a groove 71 that facilitate dividing of the fastening device into a left half and a right half by turning 74 the right half from the left half. The replacing method shown in FIG. 8A may comprise the left half and the right half according to this embodiment.

In an embodiment 1, a set comprises a supporting structure 2, such as a joist, a first panel 31, a second panel 32 and a fastening device 1 for securing the first and second panels 31, 32 to the supporting structure 2. The fastening device 1 comprises a top portion 3, having a top surface 4, a bottom surface 5, a first edge portion 16 and a second edge portion 17, a first leg 6 and a second leg 7 protruding downwardly from the bottom surface 5. The first panel 31 comprises a first edge groove 33, and the second panel 32 comprises an opposite second edge groove 34. The first edge portion 16 is configured to be inserted into the first edge groove 33 and the second edge portion 17 is configured to be inserted into the second edge groove 34. The first leg 6 and the second leg 7 are flexible and bendable towards each other. The first leg 6 comprises a first locking element 10, and the second leg 7 comprises a second locking element 11. An upper surface 18 of the supporting structure 2 comprises an insertion groove 12 comprising a first undercut groove 13 and an opposite second undercut groove 14. The first locking element 10 is configured to be snapped into the first undercut groove 13 and the second locking element 11 is configured to be snapped into the second undercut groove 14 to a locked position.

An embodiment 2 includes the set in embodiment 1, wherein a lower surface of the first locking element 10 and/or the second locking element 11 comprises a bevelled edge 21 configured to cooperate with a groove edge 22 of the insertion groove 12 during an insertion of the first leg and the second leg 6,7 into the insertion groove 12.

An embodiment 3 includes the set in embodiment 1 or 2, wherein the top surface 4 comprises a top groove 25, preferably with a curved surface, for receiving an outer edge of the second panel 32 when the second panel 32 is in angled position.

An embodiment 4 includes the set in any one of the preceding embodiments, wherein the first locking element 10 and the second locking element 11 each comprise an upper locking surface 26, and wherein the locking surface 26 of the first locking element 10 is configured to cooperate with an upper surface of the first undercut groove 13, and the locking surface 26 of the second locking element 11 is configured to cooperate with an upper surface of the second undercut groove 14.

An embodiment 5 includes the set in embodiment 4, wherein the locking surface 26 of the first and second locking elements 10, 11 each comprise a rounded or bevelled surface to enable an angled position of the fastening device 1.

An embodiment 6 includes the set in any one of the preceding embodiments, wherein a lower surface of the first locking element 10 and a lower surface of the second locking element 11 each comprise a bevelled edge or rounded edge 28 which is configured to interact with the supporting structure during an assembling.

An embodiment 7 includes the set in any one of the preceding embodiments, wherein the first leg 10 comprises a first outer surface 8 and the second leg 11 comprises a second outer surface 9, and wherein a distance between the first outer surface 8 and the second outer surface 9 is essentially the same as a width of an opening of the insertion groove 12.

An embodiment 8 includes the set in any one of the preceding embodiments, wherein the first leg 10 comprises a first outer surface 8 and the second leg 11 comprises a second outer surface 9, and wherein the first outer surface 8 and/or the second outer surface 9 comprise(s) a protruding element 27 for a vertical positioning of the fastening device 1.

An embodiment 9 includes the set in any one of the preceding embodiments, wherein the top portion 3 comprises a friction connection, such as protruding parts, configured to cooperate with the first edge groove 33 and/or the second edge groove 34 and to restrain the fastening device 1 from falling out during an assembling of the set.

An embodiment 10 includes the set in any one of the preceding embodiments, wherein the fastening device 1 comprises a polymer material, such a polyamide or polypropylene.

The invention claimed is:

1. A set comprising a supporting structure, a first panel, a second panel and a fastening device for securing the first and second panels to the supporting structure, wherein the fastening device comprises a top portion, having a top surface, a bottom surface, a first edge portion and a second edge portion, a first leg and a second leg protruding downwardly from the bottom surface, wherein the first panel comprises a first edge groove, and the second panel comprises an opposite second edge groove, the first edge portion being configured to be inserted into the first edge groove, and the second edge portion being configured to be inserted into the second edge groove, wherein:

the first leg and the second leg are flexible and bendable towards each other;

the first leg comprises a first locking element and the second leg comprises a second locking element;

an upper surface of the supporting structure comprises an insertion groove comprising a first undercut groove and an opposite second undercut groove; and the first locking element is configured to be snapped into the first undercut groove and the second locking element is configured to be snapped into the second undercut groove to a locked position, wherein the fastening device and the supporting structure are configured such that, when the first and second legs are being inserted into the insertion groove, contact between the first and second locking elements and corresponding walls of the insertion groove causes the first and second legs to bend towards each other, and wherein the first and second legs unbend in a direction away from each other at the locked position.

2. The set as claimed in claim 1, wherein a lower surface of the first locking element and/or the second locking element comprises a bevelled edge configured to cooperate with a groove edge of the insertion groove during an insertion of the first leg and the second leg into the insertion groove.

3. The set as claimed in claim 1, wherein the top surface comprises a top groove for receiving an outer edge of the second panel when the second panel is in angled position.

4. The set as claimed in claim 3, wherein the top groove of the top surface has a curved surface.

5. The set as claimed in claim 1, wherein the top portion comprises a friction connection configured to cooperate with the first edge groove and/or the second edge groove and to restrain the fastening device from falling out during an assembling of the set.

6. The set as claimed in claim 5, wherein the friction connection includes protruding parts.

7. The set as claimed in claim 1, wherein the fastening device comprises a polymer material.

8. The set as claimed in claim 7, wherein the polymer material includes polyamide or polypropylene.

9. The set as claimed claim 1, wherein the first locking element and the second locking element each comprise an upper locking surface, wherein the locking surface of the first locking element is configured to cooperate with an upper surface of the first undercut groove and the locking surface of the second locking element is configured to cooperate with an upper surface of the second undercut groove.

10. The set as claimed in claim 9, wherein the locking surface of the first and second locking elements each comprise a rounded or bevelled surface to enable an angled position of the fastening device.

11. The set as claimed in claim 1, wherein a lower surface of the first locking element and a lower surface of the second locking element each comprise a bevelled edge or rounded edge which is configured to interact with the supporting structure during an assembling.

12. The set as claimed in claim 1, wherein the first leg comprises a first outer surface and the second leg comprises a second outer surface, and wherein a distance between the first outer surface and the second outer surface is the same as a width of an opening of the insertion groove.

13. The set as claimed in claim 1, wherein the first leg comprises a first outer surface and the second leg comprises a second outer surface, wherein the first outer surface and/or the second outer surface comprise(s) a protruding element for a vertical positioning of the fastening device.

14. The set as claimed in claim 1, wherein the supporting structure includes a joist.

* * * * *